US009422093B2

(12) United States Patent
Merzeau

(10) Patent No.: US 9,422,093 B2
(45) Date of Patent: Aug. 23, 2016

(54) ARTICLE CARRIER

(75) Inventor: Julien Merzeau, Chateauroux (FR)

(73) Assignee: WestRock Packaging Systems, LLC, Norcross, GA (US)

( * ) Notice: Subject to any disclaimer, the term of this patent is extended or adjusted under 35 U.S.C. 154(b) by 31 days.

(21) Appl. No.: 14/236,536

(22) PCT Filed: Aug. 6, 2012

(86) PCT No.: PCT/US2012/049689

§ 371 (c)(1),
(2), (4) Date: Jan. 31, 2014

(87) PCT Pub. No.: WO2013/022281

PCT Pub. Date: Feb. 14, 2013

(65) Prior Publication Data

US 2014/0158561 A1 Jun. 12, 2014

Related U.S. Application Data

(60) Provisional application No. 61/515,606, filed on Aug. 5, 2011.

(51) Int. Cl.

| | |
|---|---|
| ***B65D 75/00*** | (2006.01) |
| ***B65D 71/16*** | (2006.01) |
| ***B65D 71/20*** | (2006.01) |

(52) U.S. Cl.

CPC ..... *B65D 71/16* (2013.01); *B65D 71/20* (2013.01); *B65D 2571/0066* (2013.01);
(Continued)

(58) Field of Classification Search

CPC ..... B65D 2571/0066
USPC ..... 206/145, 147, 148, 152, 154, 151, 149, 206/162, 429, 434, 427, 153, 156, 157, 158, 206/433, 435
See application file for complete search history.

(56) References Cited

U.S. PATENT DOCUMENTS 4,883,168 A * 11/1989 Dreyfus ..... B65D 71/16 206/152
5,485,915 A * 1/1996 Harris ..... B65D 71/0055 206/147

(Continued)

FOREIGN PATENT DOCUMENTS

DE 19803144 A1 * 7/1999 ..... B65D 71/20
EP 0171229 B1 3/1990

(Continued)

OTHER PUBLICATIONS

International Search Report for PCT/US2012/049689 dated Nov. 12, 2012.

*Primary Examiner* — Jacob K Ackun
*Assistant Examiner* — Jenine Pagan
(74) *Attorney, Agent, or Firm* — WestRock Intellectual Property Group

(57) ABSTRACT

An article carrier has a pair of angularly related panels (1, 14, 18, 20) and an article retaining feature (40). The angularly related panels are hingedly connected together along a fold line (26, 30). The retaining feature includes a retaining aperture (46) for receiving a portion of an article to be received in the carrier. The aperture is defined in one of the angularly related panels and extends into the other of the angularly related panels. The retaining feature further includes a tab portion (56) protruding into the aperture. The tab portion is positioned such that the fold line between the angularly related panels extends across the tab portion and terminates at an apex of the tab portion.

12 Claims, 9 Drawing Sheets

(52) U.S. Cl.
CPC ..... *B65D 2571/00197* (2013.01); *B65D 2571/00259* (2013.01); *B65D 2571/00277* (2013.01); *B65D 2571/00444* (2013.01); *B65D 2571/00759* (2013.01)

(56) References Cited

U.S. PATENT DOCUMENTS 5,549,197 A * 8/1996 Sutherland ..... B65D 71/20 206/158
5,595,299 A 1/1997 Le Bras
7,025,197 B2 * 4/2006 Sutherland ..... B65D 71/20 206/140
2012/0285855 A1 * 11/2012 Spivey, Sr. ..... B65D 71/18 206/434

FOREIGN PATENT DOCUMENTS

EP 0933307 8/1999
EP 1012062 B1 10/2002

* cited by examiner

ARTICLE CARRIER

CROSS-REFERENCE TO RELATED APPLICATIONS

This application is a National Phase application of PCT Application PCT/US2012/049689 filed Aug. 6, 2012, which claims the benefit of US Provisional Patent Application No. 61/515606, filed Aug. 5, 2011, each of which is incorporated herein by reference in their entirety.

BACKGROUND OF THE INVENTION

This invention relates to article carriers and blanks which are particularly useful for carrying articles, for example, cans or bottles. More particularly, the invention relates to an article carrier of the wrap-around type and is concerned with an improved article retention and carrier reinforcing feature which receive heel portions of cans or bottles accommodated in the carrier.

Bottle heel retention means in wraparound carriers are well known.

EP 0 171 229 B1 discloses a known bottle carrier of the wraparound type having top, bottom and side walls interconnected to form a tubular open-ended structure. A sloping heel panel interconnects each side wall along a fold line with an associated base lap panel. The bottom corners of the carton formed by the sloping heel panels comprise receiving apertures formed in each sloping heel panel which extend into the associated side wall and base lap panel. The receiving apertures form part of the bottle heel retaining feature which further comprises bottom engaging and carrier reinforcing flaps which are foldably joined along opposed peripheral edges of the bottle heel receiving apertures. In particular, EP 0 171 229 B1 discloses bottom engaging and carrier reinforcing flaps which extend across the associated sloping heel panel and into the associated side wall and base lap panel. The flaps comprise hinged portions so that in the formed bottle carrier, a portion of the bottle engaging and carrier reinforcing flap is substantially parallel with the inner surface of the associated base lap panel. In this construction, a portion of the heel of a bottle protrudes from the carrier without being protected. The tighter the package is made, the more is the tendency for the bottle heel to protrude further. Also, tears can be created in that area of the carton surrounding a receiving aperture due sometimes to an "over-tight" package and in part, at least, to any movement of a bottle acting directly against the edge of the receiving aperture.

Another type of bottle heel retaining structure is shown by WO 94/25367. This reference discloses a heel retaining flap extending primarily inwardly of the carton, although C shaped cuts provided cause a small portion of the flap to extend outwardly of the carton. The folding action of the retaining flaps is inward, i.e. the pivoting action is inward and not outward. The flaps are severed by a cut line from a sloping heel panel and the flaps are adapted to engage the heel of an article.

SUMMARY OF THE INVENTION

The present invention in one aspect provides an article carrier for packaging articles. The carrier comprises a pair of angularly related panels and an article retaining feature. The angularly related panels are hingedly connected together along a fold line. The retaining feature comprises a retaining aperture for receiving a portion of an article that is contained within the carrier. The aperture is defined in one of the angularly related panels and extends into the other of the angularly related panels. The retaining feature further comprises a tab portion protruding into the aperture. The tab portion is positioned such that the fold line between the angularly related panels extends across the tab portion and terminates at an apex of the tab portion.

In a preferred embodiment, the tab portion may have an outline that is substantially arcuate in shape, and the apex of the tab portion may be located along the outline.

In another preferred embodiment, the retaining feature may further comprise at least one flap hingedly connected to an edge of the aperture. The at least one flap may be folded inward of the carrier to abut the article in the aperture. The tab portion may be defined by a cut line in the at least one flap so that it is revealed as protruding substantially into the aperture when the at least one flap is folded inward of the carrier.

The fold line between the angularly related panels may intersect with the cut line at a substantially midpoint along the cut line.

The cut line may optionally be essentially arcuate in shape and may be curved convexly as viewed from a notional view point inside the aperture.

The at least one flap may optionally be hingedly connected to the angularly related panels along two separate fold lines, and the cut line may extend from one of the separate fold lines to the other of the separate fold lines. The separate fold lines and the cut line together may define an adjacent side edge of the at least one flap. The separate fold lines may extend divergently from the cut line toward the at least one flap.

The tab portion may optionally be shaped to conform to the profile of a diametrically reduced portion of the article received in the aperture.

In a further preferred embodiment, the tab portion may be formed in part from one of the angularly related panels and in part from the other of the angularly related panels.

In a still further preferred embodiment, the at least one flap comprises first and second flaps hingedly connected to opposed side edges of the aperture respectively, In a still further preferred embodiment, the retaining feature may be provided at a position next to one of the opposite ends of the carrier, and the fold line between the angularly related panels may extend from the apex of the tab portion to the one of the opposite ends of the carrier.

In a still further embodiment, part of the perimeter of the aperture may be shaped to define the tab portion.

In a still further embodiment, one of the angularly related panels may include a side panel and a heel panel hingedly connected to a lower edge of the side panel, and the other of the angularly related panels may be a base panel hingedly connected at least in part to the lower edge of the heel panel.

The present invention in another aspect provides a blank for forming an article carrier. The blank comprises first and second panels which are to be angularly related when the blank is erected into a carrier. The first and second panels are hingedly connected together along a fold line. The blank further comprises an article retaining feature which comprises a retaining aperture for receiving a portion of an article. The aperture is defined in one of the first and second panels and extends into the other of the first and second panels. The retaining feature further comprises at least one flap hingedly connected to an edge of the aperture. The at least one flap is formed with a cut line that defines a tab portion protruding from the first and second panels into the at least one flap. The tab portion is positioned such that the fold line between the first and second panels extends across the tab portion and terminates at an apex of the tab portion.

In a preferred embodiment, the fold line between the first and second panel intersect with the cut line at a substantially midpoint along the cut line.

In another preferred embodiment, the cut line may be essentially arcuate in shape and may be curved convexly as viewed from a notional view point inside the aperture.

In another preferred embodiment, the at least one flap may be hingedly connected to the first and second panels along two separate fold lines, and the cut line may extend from one of the separate fold lines to the other of the separate fold lines.

In a further preferred embodiment, the tab portion may be formed in part from one of the first and second panels and in part from the other of the first and second panels.

In a still further preferred embodiment, the retaining feature may be provided at a position next to one of the opposite side edges of the blank. The fold line between the first and second panels may extends from the apex of the tab portion to the one of the opposite side edges of the blank.

BRIEF DESCRIPTION OF THE DRAWINGS

An embodiment of the invention will now be described by way of example only with reference to the accompanying drawings in which.

DETAILED DESCRIPTION OF THE PREFERRED EMBODIMENT

Figure 1:
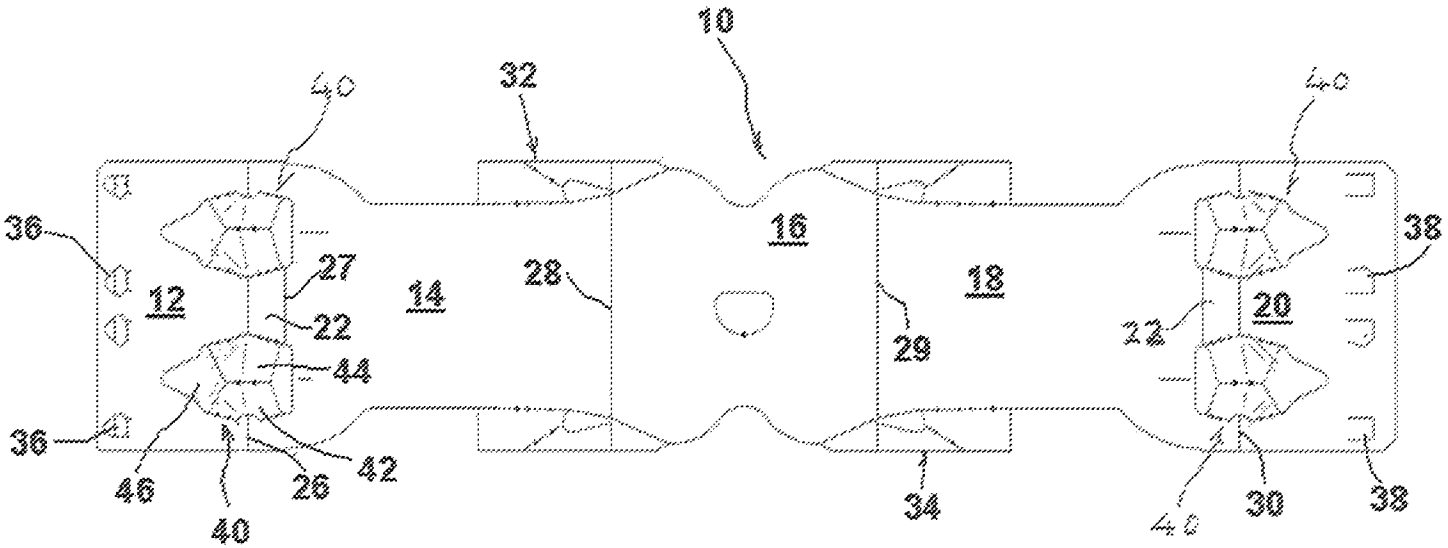
FIG. 1 is a plan view of a blank for forming a carrier having bottom retaining features according to the present disclosure.
Figure 2:
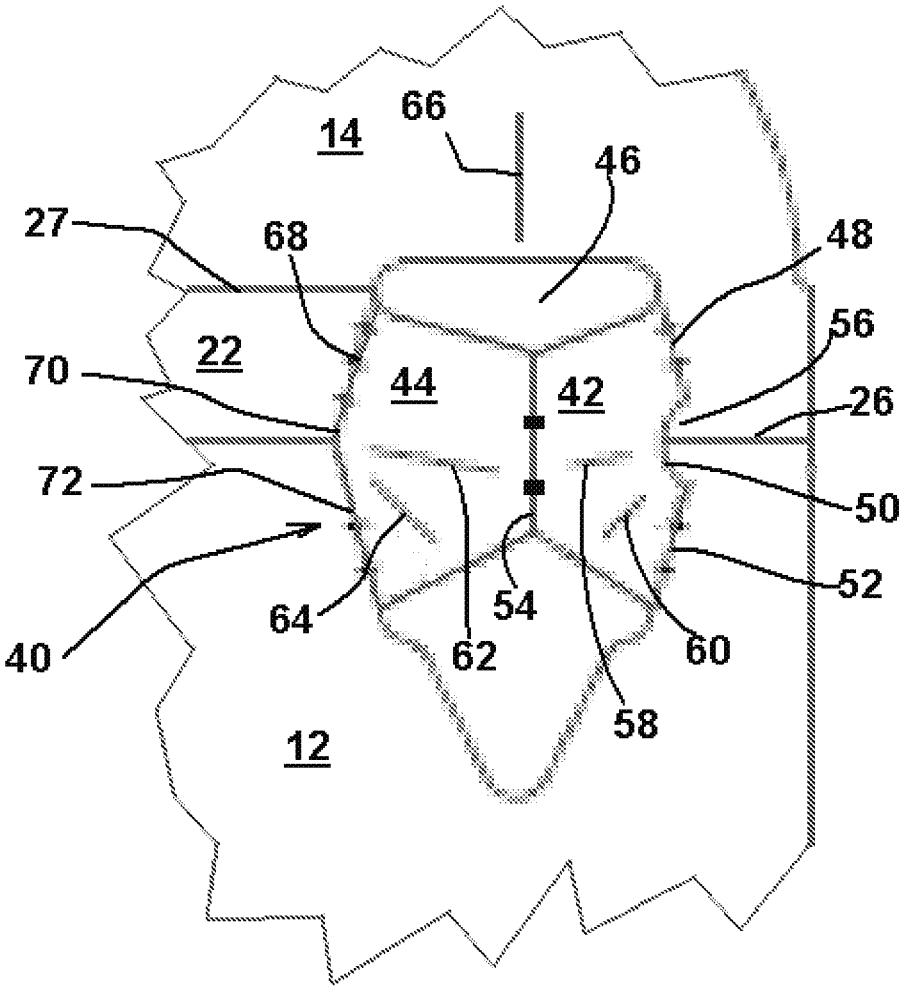
FIG. 2 is an enlarged plan view of one of the retaining features in FIG. 1.

Referring to FIGS. 1 and 2, there is shown a blank 10 for forming a wrap-around article carrier having heel retaining features 40 according to the present disclosure. The blank 10 comprises a plurality of primary panels that include a first base panel 12, a first heel panel 22, a first side panel 14, a top panel 16, a second side panel 18, a second (or another) heel panel 22 and a second base panel 20. These primary panels are hingedly connected one to the next by respective fold lines 26, 27, 28, 29, 27, 30 so that the primary panels are capable of forming a tubular structure that can wrap around a group of articles such as cans or bottles. The blank 10 further comprises a plurality of retaining features 40. Each retaining feature 40 is formed in the respective base panel 12 or 20 and extends into the adjacent side wall comprising the first or second side panel 14 or 18 and its associated heel panel 22. Each retaining feature 40 is not necessarily exclusively intended for the heel or lower portion of an article and may be used, for example, for an upper shoulder or upper portion of an article. In the embodiment wherein the retaining features are provided for the shoulder portions of the packaged articles, each of such retaining features may be formed in the respective top panel 16 and may extend into the adjacent side wall. The retaining feature 40 can be formed at the ends of the tubular structure of the article carrier, for example, to retain the end corner articles or alternatively, can be provided for only any one or more of the articles held in a carrier. The blank of FIG. 1 is designed to package four cans of a 2×2 configuration. As such, all the four retaining features 40 serve to retain end corner cans when the blank 10 is erected into a carrier. Reference numerals "32" and "34" denote additional panels at the opposite ends of each of the first and second side panels 14, 18.

Figure 3:
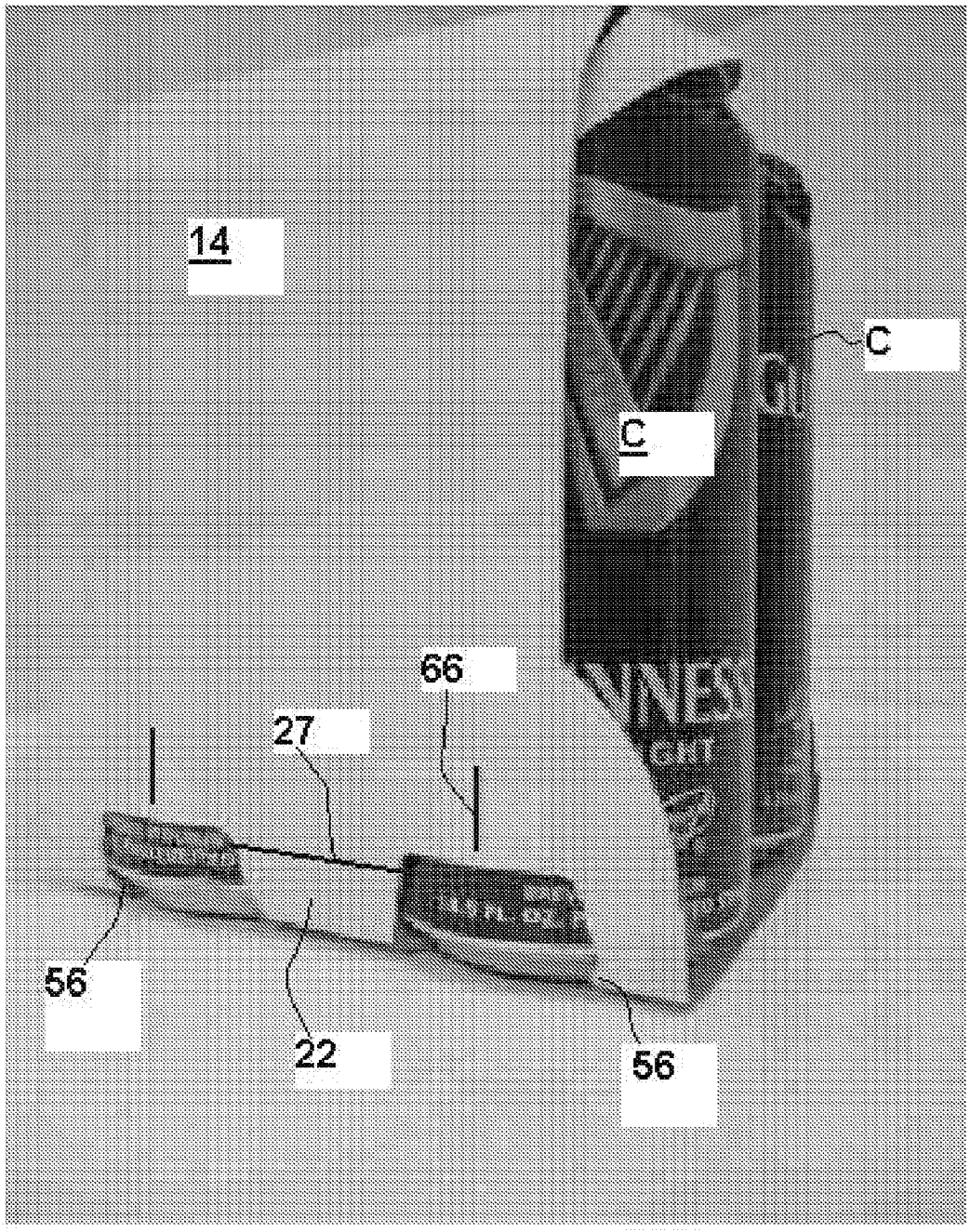
FIG. 3 is a perspective view of an erected carrier formed from the blank of FIG. 1 with cans received in the carrier.
Figure 4:
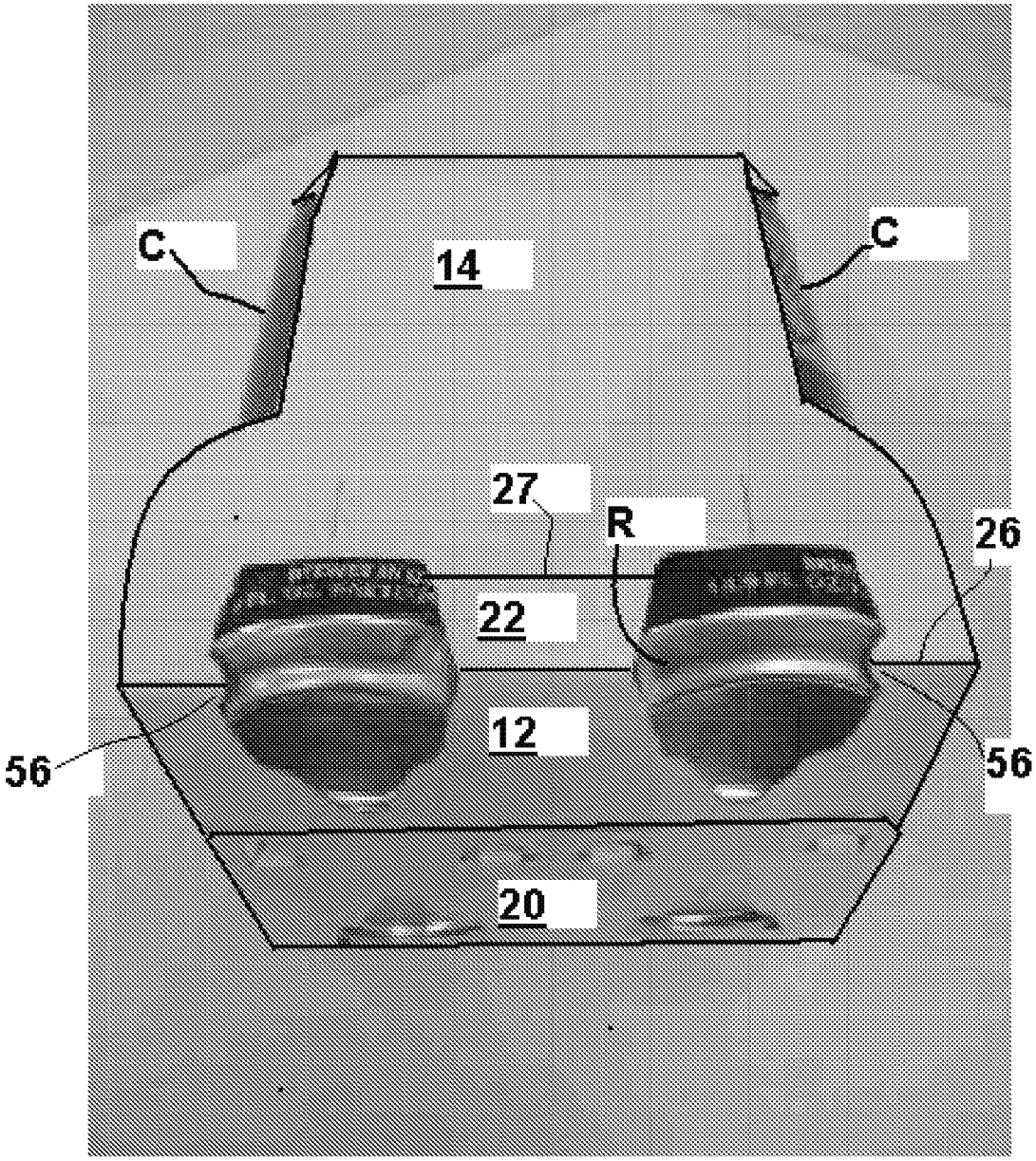
FIG. 4 is a bottom-side perspective view of the carrier of FIG. 3, showing the heels of the cans received in receiving apertures.
Figure 5:
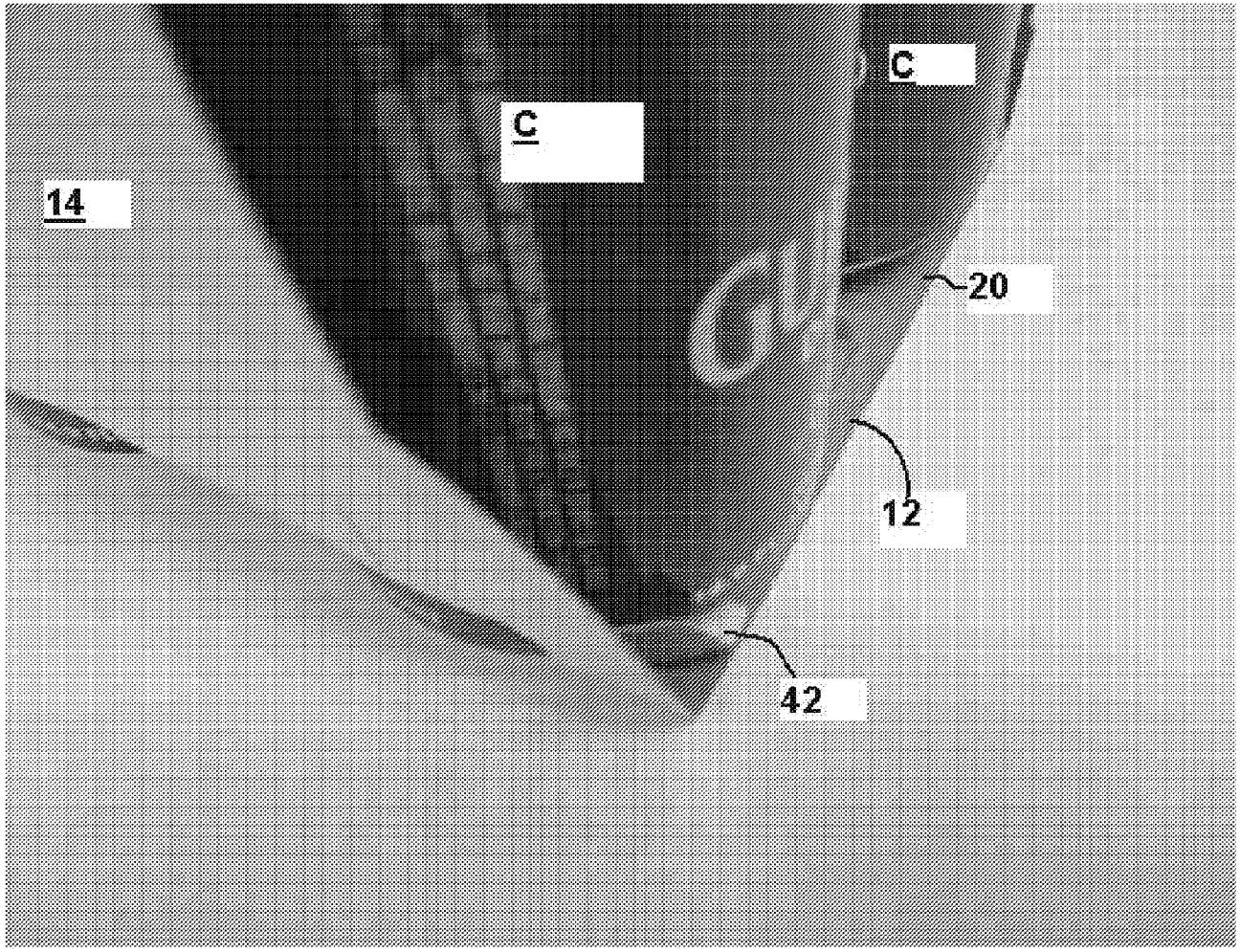
FIG. 5 is an enlarged perspective view of the carrier of FIG. 3, showing one of the inwardly-folded, engaging and reinforcing flaps that is in engagement with an end can.
Figure 6:
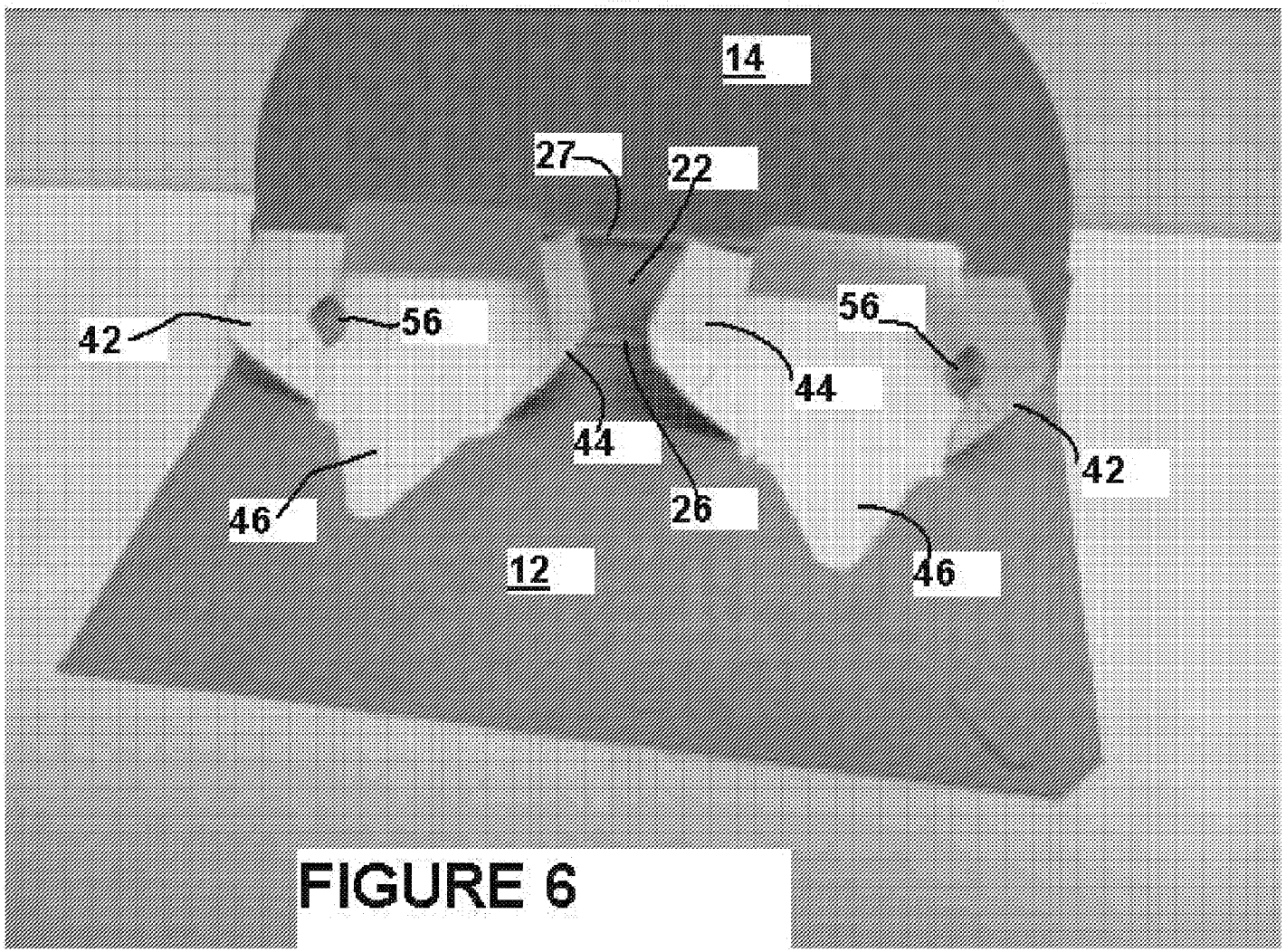
FIG. 6 is a perspective view of the heel-retaining features viewed from the inside of the carrier.

Each retaining feature 40 comprises a retaining aperture 46 which in this example receives the heel of a can C, as shown in FIGS. 3 and 4. Each retaining feature 40 also comprises retaining flaps 42, 44 which in the erected carrier provide internal flaps which abut that part of the heel of the article C adjacent the respective heel panel 22. The general form of flap is known and is described in detail, for example, in WO94/25363 which is hereby incorporated by reference.

Referring in particular to FIG. 2, each retaining feature 40 in this particular embodiment comprises a first flap 42 that is divided into upper, middle and lower flap portions by two fold lines 58, 60. The upper portion is defined between the fold line 58 and the upper edge of the first flap 42 and is hinged to the side wall 14 along a fold line 48. (The heel panel 22 is not provided at the respective carrier end since the fold line 27 extends between the two adjacent retaining features only and it does not further extend beyond the retaining features.) The middle portion is defined between the fold lines 58, 60 and is hinged to the upper portion along fold line 58 and to the lower portion along fold line 60. The middle portion is partially defined by an arcuate cut line 50 and thus is not directly connected to either the adjacent side panel 14 or base panel 12. The lower flap portion is defined between the fold line 60 and the lower edge of the flap 42 and is hinged to base panel 12 along a fold line 52. The fold lines 48 and 52 are spaced from one another with the arcuate cut line 50 extending therebetween. These spaced fold lines 48, 52 are in a divergent relationship to define therebetween an obtuse angle. The fold lines 48, 52 extend from the arcuate cut line 50 divergently toward the first flap 42.

Referring further to FIG. 2, the arcuate cut line 50 extends from fold line 48 to fold line 52 to define a tab portion 56 which is shaped to conform to the profile of a diametrically reduced portion "R" of the associated article that, in this embodiment, is a can "C". Such a diametrically reduced portion "R" is shown in FIG. 4 in which the diametrically reduced (or tapered) portion R is positioned in a substantial horizontal alignment with the fold line 26. Articles, cans in particular, often include such a diametrically reduced portion of a standard size, which is typically about 1 cm in width. The fold line 26 between the side panel 14 and the base panel 12 extends from the end edge of the blank 10 and is interrupted by the arcuate cut line 50. The point of the interruption is located at a substantially mid point along the arcuate cut line 50 and is spaced substantially from the opposite ends of the arcuate cut line 50. Stated differently, the point of interruption is located at around the apex of the tab portion 56 wherein the apex is located midway along the arcuate outline of the tab portion 56 that is defined by the arcuate cut line 50. This arrangement contributes to reinforcing or strengthening the area of the blank 10 between the aforementioned end edge of the blank and the aperture 46 in order to minimize development of tears in and around that area.

Returning to FIG. 2, it is envisaged that the shape of the cut line 50 can be altered according to the particular profile of the diametrically reduced portion of the associated article. The fold lines 48, 52 and cut line 50 together define the respective side edge of the first flap 42. Apparent from FIG. 2, the first flap 42 is struck or formed from the primary panels (or side and base panels) 14, 12 and more particularly from the material of the blank 10 taken from the area of the aperture 46. The first flap 42 is pivotal about the fold lines 48 and 52.

Similarly, a second flap 44 comprises upper, middle and lower flap portions bounded by fold lines 62, 64. In the illustrated embodiment, the second flap 44 has a width greater than that of the first flap 42 and separated from the first flap 42 along the central cut line 54. It is anticipated that the two flaps 42, 44 need not necessarily be provided and indeed, only the first flap may be provided in a given retaining feature 40. It is envisaged that where two flaps are provided, they need not abut along cut line 54 and indeed, a substantial gap could be provided between the flaps, for example. Reference numeral "66" denotes a line in the first side panel 14 located above the aperature 46.

The upper portion of the second flap 44 is defined between its upper edge and the fold line 62 and is foldably connected to the heel panel 22 along a fold line 68. The middle portion of the second flap 44 is defined between the fold lines 62, 64. The lower portion of the second flap 44 is defined between the fold line 64 and the lower edge of the second flap 44 and is hingedly connected to base panel 12 along fold line 72. An arcuate cut line 70 extends from fold line 68 to fold line 72; however, the orientation of the cut line 70 is opposite to that of the cut line 50 in the sense that the resultant tab portion remains attached to, or integral with, the respective flap 44 and protrudes outward of the receiving aperture 46 as opposed to the tab portion 56 which is integral with the primary panels 12, 14 and protrudes inward of the aperture 46. However, the orientation of the cut line 70 may be altered such that the resultant tab portion is attached to the primary panels 12, 22 and protrudes inwardly of the aperture 46. The fold lines 68, 72 and cut line 70 together define the respective side edge of the second flap 44. The second flap 44 is struck or formed from the primary panels 12, 22, 14 and more particularly from the material of the blank 10 taken from the area of the aperture 46. The second flap 44 is pivotal about fold lines 68, 72. When both the flaps 42, 44 are co-planer, e.g., when the carrier is in blank form illustrated in FIGS. 1 and 2, the aperture 46 is closed at least in part.

In the illustrated embodiment, the carrier is formed to package two rows of two cans. The blank 10 shown in FIG. 1 comprises retaining features 40 (for one of the two rows of cans) formed from side panel 14, the heel panel 22 and the base panel 12. The blank 10 further comprises retaining features 40 (for the other row of cans) formed from the side panel 18, the heel panel 22 and the base panel 20. The retaining features 40 for the other row are substantially the same as the retaining features 40 and therefore are not described in any greater detail.

In order to erect a wraparound carrier from the blank 10, the top panel 16 of the carrier blank 10 is applied to the tops of a group of articles C to be packaged in the carrier, and the side walls 14, 18 are folded downwardly to be disposed in flanking relationship along the side walls of the articles. During and/or before the side wall folding process, the flaps 42, 44 are displaced inwardly toward the article group by suitable means which may be similar, at least in function, to those known, for example, from WO 94/25363. Displacement of the flaps 42, 44 thus causes the flaps 42, 44 to be disposed internally of the carrier to reveal tab portion 56. The heel portion of an article C is thereby received in the aperture 46 as well as by the flaps 42, 44 of the respective retaining feature 40. The tab portion 56 engages the diametrically reduced portion R of the associated article C as shown in FIG. 4. The tab portion 56 can be pressed against the article to provide a tighter carrier and can engage the diametrically reduced portion R to restrict movement of the article C along the cylindrical axis such as the can axis. The respective base panel 20 can then be folded inwardly and upwardly into engagement with the base portions of the articles C. A similar operation on the other side of the group of articles is also performed, and the base panel 12 is placed in an overlapping relationship with the base panel 20. These base panels 12, 20 are secured together by means known in the art, e.g., gluing or mechanical locks such as shown in FIG. 1 at 36, 38. By securing the base panels together, the wraparound carrier can be completed as shown in FIG. 4 in which the top panel 16 and either side walls are angularly related while each side wall and the adjacent base panel 12 or 20 are also angularly related. In the application the term "angularly related" refers to a relationship between two panels which are disposed to define therebetween any angle other than 0 and 180 degrees and preferably an angle about 90 degrees.

After the base panels 12, 20 have been secured together, the carrier is in an erected condition and the retaining features 40 are such that the internal engaging and reinforcing flaps 42, 44 are provided to engage the heels of the articles C. Further, the protruding tab portions 56 engage the diametrically reduced portions R of the cans C. Thus, the engaging flaps 42, 44 and protruding tab portions 56 are particularly able to conform to the bottom or heel portions of the articles. The tab portions 56 in particular are positioned such that the adjacent fold line 26 between the adjacent base panel 12 or 20 and the adjacent side wall 14, 22; or 18, 22 intersects with the respective cut line 50 at the substantially mid point along the cut line 50. The "mid point" in this application refers to a position spaced substantially from the opposite ends of the respective cut line 50 which is curved convexly as viewed from a notional view point inside the aperture 46. The tab portion 56 defined by such a cut line 50 protrudes into the first flap 42 as viewed in FIG. 2 and projects substantially into the aperture 46 when the first flap 42 is folded inwardly of the carrier (see FIGS. 3-6.) Stated differently, the fold line 26 extends across the tab portion 56 and terminates at the apex of the protruding tab portion 56.

Drop Impact Test

Figure 8:
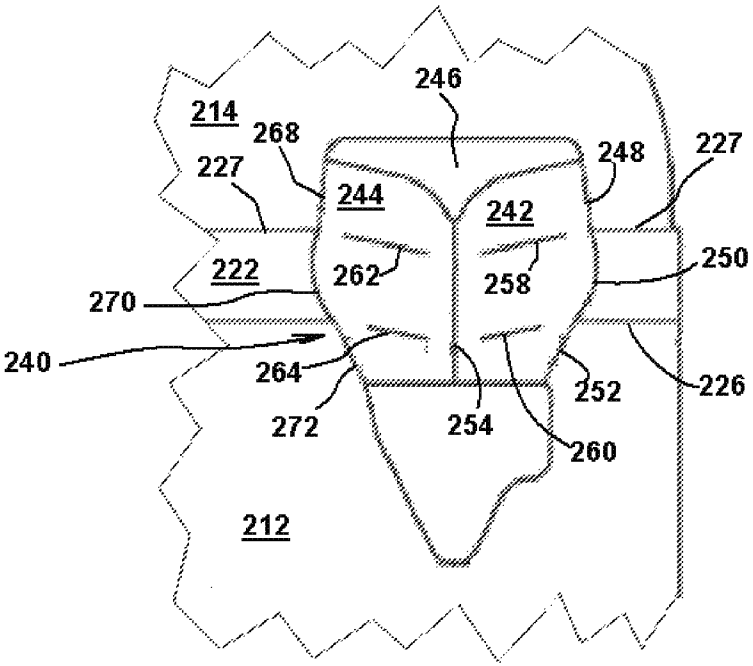
FIG. 8 is an enlarged plan view of another conventional heel retaining feature showing its initial flat condition similar to FIG. 7.
Figure 7:
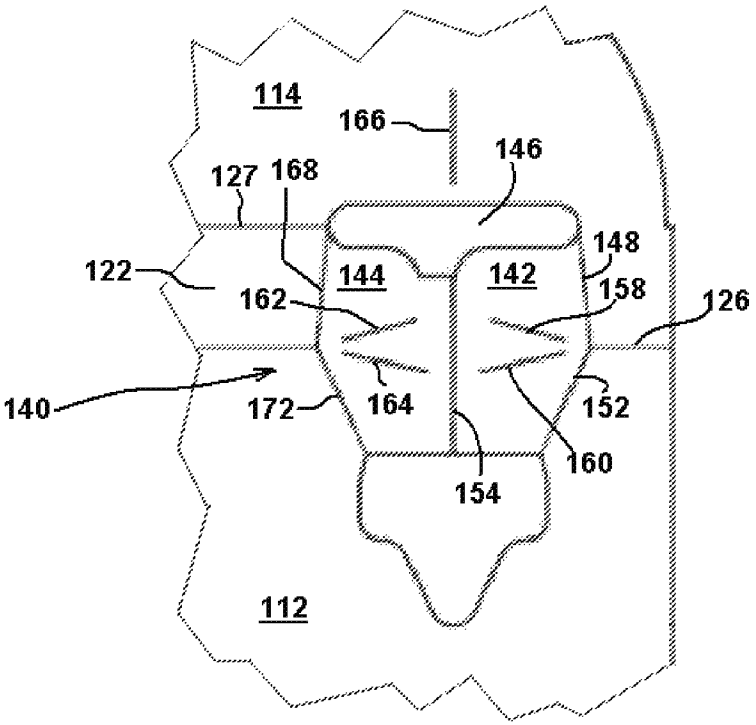
FIG. 7 is an enlarged plan view of a conventional heel retaining feature, showing its initial flat condition in which the engaging and reinforcing flaps lay flat with the respective carrier blank.

Twelve carrier samples (or test specimens) I each identical in the size and structure to the carrier of FIGS. 1-6 are prepared. Twelve conventional carrier samples (or control specimens) II and twelve conventional carrier samples (or control specimens) III are prepared. Conventional carrier samples II each has the retaining feature 140 shown in FIG. 7 while carrier samples III each has the retaining feature 240 shown in FIG. 8. The size and structures of each of the carrier samples II and III are substantially the same as the carrier shown in FIGS. 1-6 except their respective retaining features. The reference numerals used in FIGS. 7 and 8 are similar to those used in FIG. 2 in that they designate corresponding portions of the retaining feature 40 respectively. The reference numerals in FIGS. 7 and 8 differ from those in FIG. 2 in that they are preceded by the prefix "1" and by the prefix "2", respectively. Except for the function of the cut line 50 and tab portion 56, the functions of the denoted portions in FIG. 2 are similar to that of those denoted in FIGS. 7 and 8. Therefore, further description of FIGS. 7 and 8 are omitted. The test and control carrier samples I, II and III are each tested to determine:

The resistance to impact applied to the respective carrier sample when the samples are dropped from a certain elevation.

The test carrier samples I are formed from paperboard material having a thickness of about 350 gsm (gram per square meter). The control carrier samples sample II are formed from the paperboard material having a thickness of about 380 gsm while the control carrier samples III are formed from paperboard material of a thickness of about 350 gsm. The paperboard material used for all the carrier samples I, II and II are coated natural craft board identified as "CNK" which is a trademark of MeadWestvaco Corporation.

All tests were carried out after applying each carrier sample to a group of four cans of a 2×2 configuration and thereby making a loaded packaging and by dropping the package from the elevation of 50 cm measured from a flat surface on which the package is dropped. Each can used for the tests has a capacity of 47 cl and identified as "202" can and has been loaded with the corresponding amount of beer.

Figure 9:
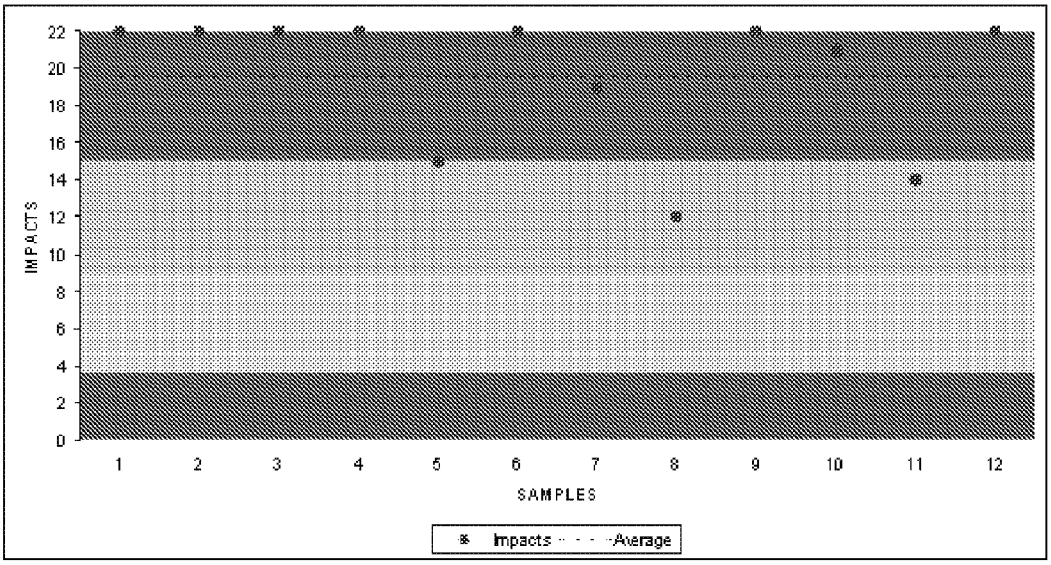
FIG. 9 is a diagram showing the result of a dropping test performed on substantially identical carrier samples each being similar to the carrier shown in FIG. 1.
Figure 10:
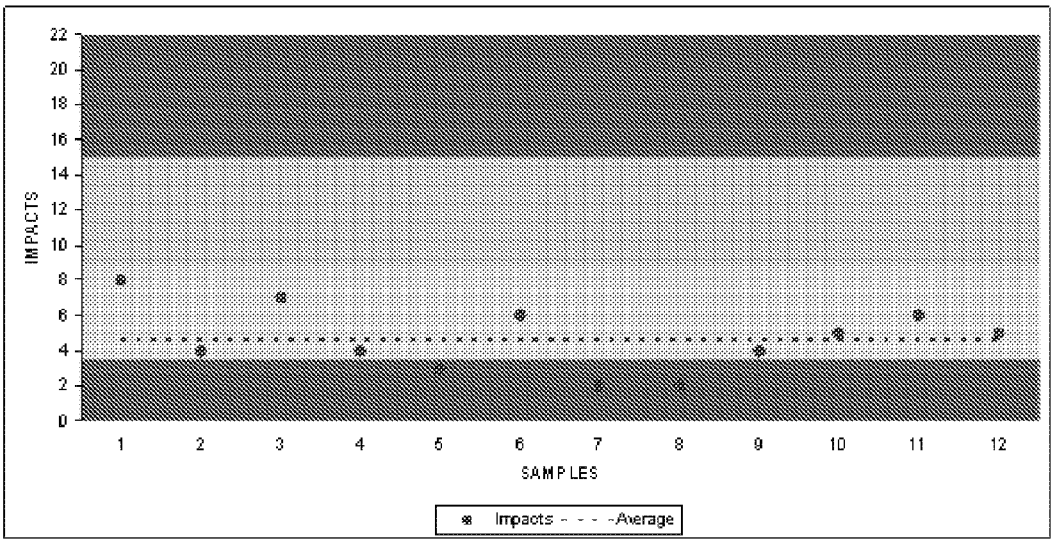
FIG. 10 is a diagram showing the result of a dropping test on carrier samples having the heel retaining features shown in FIG. 7.
Figure 11:
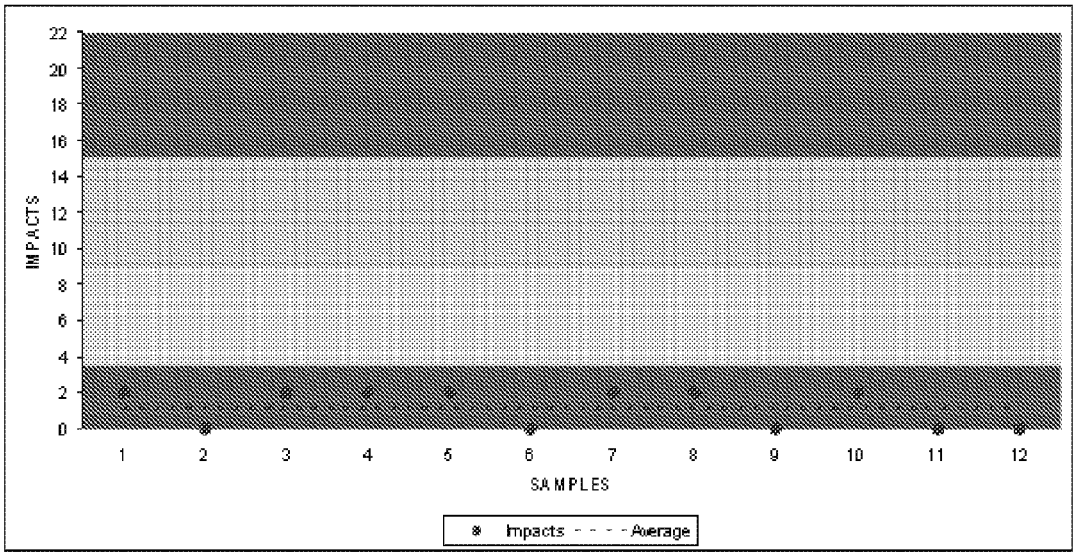
FIG. 11 is a diagram showing the test result of a dropping test on carrier samples having the heel retaining features shown in FIG. 8.

The test results are presented in the diagrams shown in FIGS. 9-11. As described earlier, twelve carrier samples were tested for each type of sample (I-III). The sample numbers 1-12 are shown along the abscissa in each of FIGS. 9-11. The number of the times each package was dropped was counted till one or more tears extended from at least one of the receiving apertures all the way through the adjacent carrier edge or till any can in the package exits from the package. The numbers of times the carrier samples are dropped are given along the ordinate in each of FIGS. 9-11. FIG. 9 shows the drop test results for carrier samples I, FIG. 10 shows those for carrier samples II and FIG. 11 shows those for carrier samples III. The minimum, maximum and average of the number of the times the carrier samples are dropped are given in the following table.

| | Min. | Max. | Average |
|---|---|---|---|
| Samples I | 12 | More than 22 | 19.58 |
| Samples II | 2 | 8 | 4.67 |
| Samples III | 0 | 2 | 1.17 |

The results demonstrate that the carrier of the present disclosure can increase the impact resistance of a carrier formed from the same material. The carrier of the present disclosure can even provide a superior impact resistance than a conventional carrier formed from a thicker material.

It can be appreciated that various changes may be made within the scope of the present disclosure, for example, the present disclosure is not limited in its application to paperboard, but may be envisaged that the present disclosure may usefully be employed with other types of foldable sheet material including paper, cardboard and plastics materials.

It is apparent that the improved conformity of the carrier provided by the present disclosure enables a relatively strong package tightening whilst minimizing the risk of tearing.

Further, the present disclosure is not limited to a configuration as described above, and it is envisaged, it would be possible to provide a retaining feature according to the present disclosure comprising one or more hinged connections per engaging and reinforcing flap in order to enable the protruding tab portion to be provided in the assembled carrier.

The present disclosure and its preferred embodiment relate to an article carrier which is shaped to provide satisfactory strength to hold the articles securely but with a degree of flexibility so that the load transferred to the retaining features is absorbed by the carrier. The carrier can be applied to an array of bottles by hand or automatic machinery.

The invention claimed is:

1. A combination comprising a plurality of cans and a can carrier for packaging the cans, the can carrier comprising a pair of angularly related panels and a can retaining feature, the angularly related panels being hingedly connected together along a fold line, the retaining feature comprising a retaining aperture for receiving a portion of a can within the carrier, the aperture being defined in one of the angularly related panels and extending into the other of the angularly related panels, the retaining feature further comprising a tab portion protruding into the aperture, the tab portion being positioned such that the fold line between the angularly related panels extends across the tab portion, and wherein the tab portion is shaped to conform to a profile of a diametrically reduced portion of the can received in the aperture, wherein the retaining feature further comprises at least one flap hingedly connected to an edge of the aperture, the at least one flap being folded with respect to the angularly related panels, wherein the tab portion is defined by a cut line in the at least one flap so that tab portion is revealed as protruding substantially into the aperture when the at least one flap is folded with respect to the angularly related panels, wherein the at least one flap is hingedly connected to the angularly related panels along first and second separate fold lines respectively, wherein the cut line extends from the first fold line to the second fold line to define the tab portion which extends between the first and second fold lines, and wherein the fold line between the angularly related panels is disposed between the first and second fold lines and extends across the tab portion.

2. The combination of claim 1, wherein the tab portion is in engagement with the diametrically reduced portions of the can received in the aperture.

3. The combination of claim 1, wherein the cut line defines an outline of the tab portion, the tab portion has an apex along the outline, and the fold line terminates at the apex of the tab portion.

4. The combination of claim 3, wherein the outline of the tab portion is substantially arcuate in shape.

5. The combination of claim 1, wherein the at least one flap is folded inward of the carrier to abut the can received in the aperture, and wherein the tab portion is revealed as protruding substantially into the aperture when the at least one flap is folded inward of the carrier.

6. The combination of claim 1, wherein the cut line is essentially arcuate in shape and is curved convexly as viewed from a notional view point inside the aperture.

7. The combination of claim 1, wherein the at least one flap comprises first and second flaps hingedly connected to opposed side edges of the aperture respectively.

8. The combination of claim 1, wherein the aperture is provided at a position next to one of opposite ends of the carrier, and the fold line between the angularly related panels extends from the tab portion to the one of the opposite ends of the carrier.

9. The combination of claim 1, wherein the fold line between the angularly related panels intersects with the cut line at a point spaced substantially from opposite ends of the cut line.

10. The combination of claim 9, wherein the point is located at a substantially midpoint along the cut line.

11. The combination claim 1, wherein the angularly related panels are connected directly to each other along the fold line between the angularly related panels.

12. The combination of claim 1, wherein the angularly related panels are disposed to define therebetween an angle about 90 degrees.

* * * * *